US006729273B2

(12) United States Patent
Aoyama et al.

(10) Patent No.: US 6,729,273 B2
(45) Date of Patent: May 4, 2004

(54) PISTON ACTUATION SYSTEM OF V-TYPE ENGINE WITH VARIABLE COMPRESSION RATIO MECHANISM

(75) Inventors: Shunichi Aoyama, Kanagawa (JP); Katsuya Moteki, Tokyo (JP); Hiroya Fujimoto, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/059,012

(22) Filed: Jan. 30, 2002

(65) Prior Publication Data

US 2002/0117129 A1 Aug. 29, 2002

(30) Foreign Application Priority Data

Feb. 28, 2001 (JP) ..... 2001-054392

(51) Int. Cl.[7] ..... F02D 15/00
(52) U.S. Cl. ..... 123/48 B; 123/197.4
(58) Field of Search ..... 123/197.4, 48 B

(56) References Cited

U.S. PATENT DOCUMENTS 1,039,492 A * 9/1912 Courtwright ..... 123/197.4
2,909,163 A * 10/1959 Biermann ..... 123/48 B
2,909,164 A * 10/1959 Biermann ..... 123/48 B
4,270,495 A * 6/1981 Freudenstein et al. ... 123/197.4
4,957,069 A 9/1990 Mederer
6,058,901 A * 5/2000 Lee ..... 123/197.4
6,349,694 B1 * 2/2002 Babington ..... 123/197.4

FOREIGN PATENT DOCUMENTS

DE 37 11729 A1 10/1988
WO WO 99/28607 6/1999

OTHER PUBLICATIONS

Von Christoph Bollig et al., "Kurbeltrieb fur variable Verdichtung," *MTZ Motortechnische Zeitschrift*, 58(11): 706–711, (1997).

* cited by examiner

*Primary Examiner*—Henry C. Yuen
*Assistant Examiner*—Jason Benton
(74) *Attorney, Agent, or Firm*—Foley & Lardner

(57) ABSTRACT

In a piston actuation system of a V-type internal combustion engine with two cylinder banks having at least one pair of cylinders, a piston pin, an upper link, a lower link, and a control link are mechanically linked to each other for each cylinder bank. When changing a compression ratio of the engine, ends of the control links of the two cylinder banks are moved in synchronism. The lower links of the two cylinder banks are coaxially rotatably fitted on the outer periphery of the same crankpin whose axis is eccentric to the axis of the crankshaft.

16 Claims, 11 Drawing Sheets

LINKAGE CONSTRUCTION OF LEFT BANK

LINKAGE CONSTRUCTION OF RIGHT BANK

PISTON STROKE CHARACTERISTIC OF LEFT AND RIGHT BANKS IN TWO-CYCLE V-6 ENG.

120° BANK ANGLE

90° ABDC

150° ABDC

30° ATDC

90° ATDC

150° ATDC

30° ABDC

PISTON STROKE CHARACTERISTIC OF LEFT AND RIGHT BANKS IN FOUR-CYCLE V-6 ENG.

PISTON ACTUATION SYSTEM OF V-TYPE ENGINE WITH VARIABLE COMPRESSION RATIO MECHANISM

TECHNICAL FIELD

The present invention relates to a piston actuation system of a V-type internal combustion engine with a variable compression ratio mechanism, and specifically to the improved arrangement of a multiple-link variable compression ratio mechanism on a crankshaft of a V-type internal combustion engine.

BACKGROUND ART

On V-type four-cycle engines, such as V-6 four-cycle engines, in order to shorten the engine's overall length, adjacent crankpins for at least one pair of cylinders in left and right cylinder banks, for example a crankpin number 1 and a crankpin number 2 are arranged within a span of two adjacent main bearing journals (e.g., a main bearing journal number 1 and a main bearing journal number 2). The adjacent crankpins are often offset from each other. In case of such an offset arrangement of two adjacent crankpins, an axial dimension of each crankpin is shortened by a reinforcing crankshaft web space, as compared to in-line engines. On V-type engines with an offset crankpin arrangement, there are problems of the greatly limited space around the crankpin and insufficient crankshaft strength.

In recent years, there have been proposed and developed various reciprocating piston engines with a variable compression ratio mechanism. Generally, the variable compression ratio mechanism has a plurality of links mechanically linking a crankpin and a piston pin. By varying a condition of restriction of a motion of one link of the links, a compression ratio of the engine changes One such variable compression ratio mechanism has been disclosed in pages 706–711 of the issue for 1997 of the paper "MTZ Motortechnische Zeitschrift 58, No. 11".

On reciprocating piston engines with a relatively complicated variable compression ratio mechanism, it is important to compactly reasonably arrange component parts of the variable compression ratio mechanism. In particular, on V-type reciprocating piston engines, pistons in left and right banks are driven by only one crankshaft, and therefore linkage parts of variable compression ratio mechanisms included in the left and right banks tend to be gathered together closely around the crankshaft. For this reason, a V-type engine with a variable compression ratio mechanism requires a compact and reasonable layout of the linkage parts on the crankshaft.

SUMMARY OF THE INVENTION

Accordingly, it is an object of the invention to provide a piston actuation system of a V-type engine with a multiple-link variable compression ratio mechanism, which avoids the aforementioned disadvantages.

It is another object of the invention to provide a piston actuation system of a V-type engine with a multiple-link variable compression ratio mechanism, which is capable of realizing a simple linkage layout, while using a common crankpin to at least one pair of cylinders in left and right cylinder banks.

In order to accomplish the aforementioned and other objects of the present invention, a piston actuation system of a V-type internal combustion engine with a crankshaft and two cylinder banks having at least one pair of cylinders whose centerlines are set at a predetermined bank angle to each other, a pair of pistons slidably disposed in the respective cylinders, comprises a pair of upper links connected to piston pins of the pistons so as to be rotatable relative to the respective piston pins, a pair of lower links connected to the upper links so as to be rotatable relative to the respective upper links, a pair of control links connected at their first ends to the lower links so as to be rotatable relative to the respective lower links, a control mechanism that is connected to the second end of each of the control links to move the second end of each of the control links relative to a body of the engine when changing a compression ratio of the engine, and a crankpin whose axis is eccentric to an axis of the crankshaft and on which a first one of the pair of lower links is rotatably fitted and a crankpin whose axis is eccentric to the axis of the crankshaft and on which the second lower link is rotatably fitted, being coaxially arranged with each other.

According to another aspect of the invention, a piston actuation system of a V-type internal combustion engine with a crankshaft and two cylinder banks having at least one pair of cylinders whose centerlines are set at a predetermined bank angle to each other, a pair of pistons slidably disposed in the respective cylinders, comprises a pair of upper links connected to piston pins of the pistons so as to be rotatable relative to the respective piston pins, a pair of lower links connected to the upper links so as to be rotatable relative to the respective upper links, a pair of control links connected at their first ends to the lower links so as to be rotatable relative to the respective lower links, a control mechanism that is connected to the other end of each of the control links to move the second end of each of the control links relative to a body of the engine when changing a compression ratio of the engine, and the pair of lower links being fitted on an outer periphery of the same crankpin whose axis is eccentric to an axis of the crankshaft.

The other objects and features of this invention will become understood from the following description with reference to the accompanying drawings.

DESCRIPTION OF THE PREFERRED EMBODIMENTS

Figure 1:
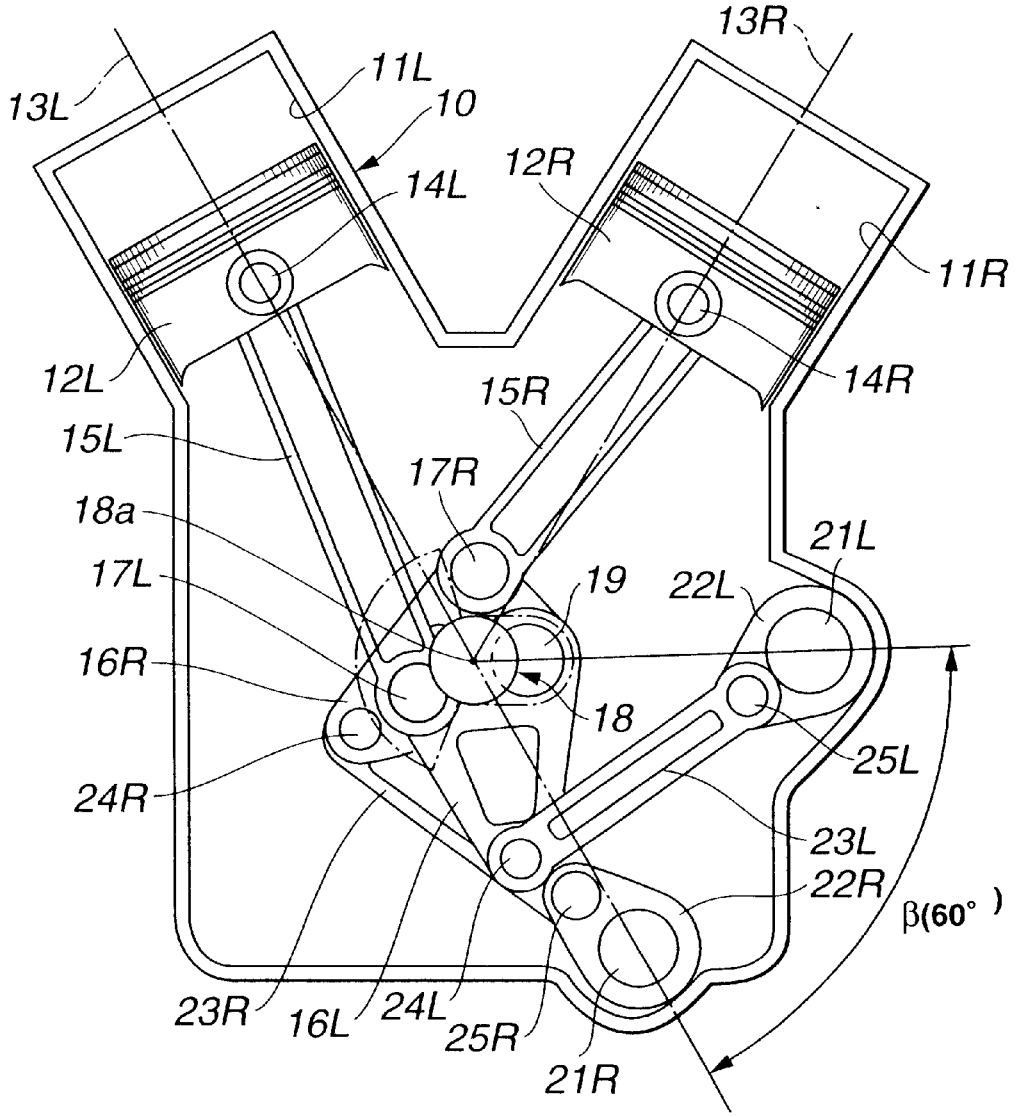
FIG. 1 is a cross-sectional view illustrating a piston actuation system of a V-6 two-cycle engine equipped with a multiple-link variable compression ratio mechanism, in a first embodiment.
Figure 2:
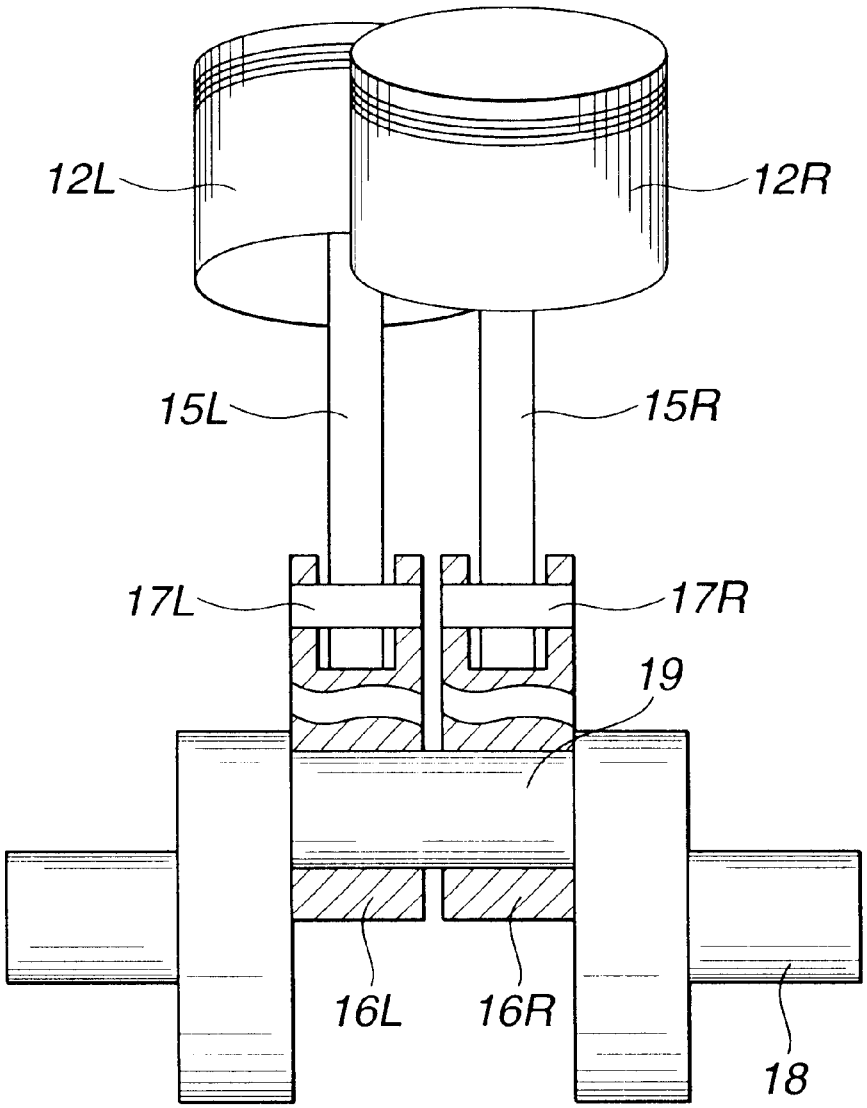
FIG. 2 is a side view illustrating a part of the variable compression ratio mechanism incorporated in the V-6 two-cycle engine of the first embodiment.
Figure 3:
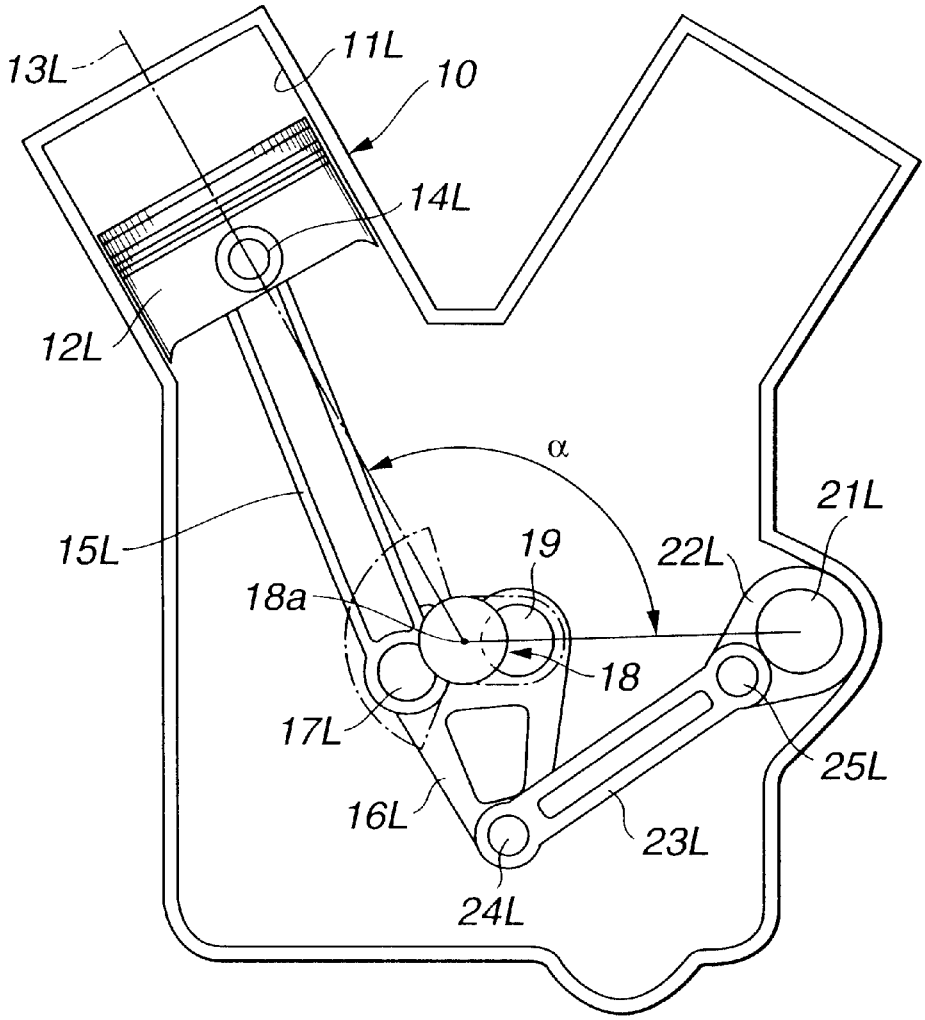
FIG. 3 is a cross-sectional view illustrating a detailed linkage construction of the left cylinder bank side of the V-6 two-cycle engine of the first embodiment.
Figure 4:
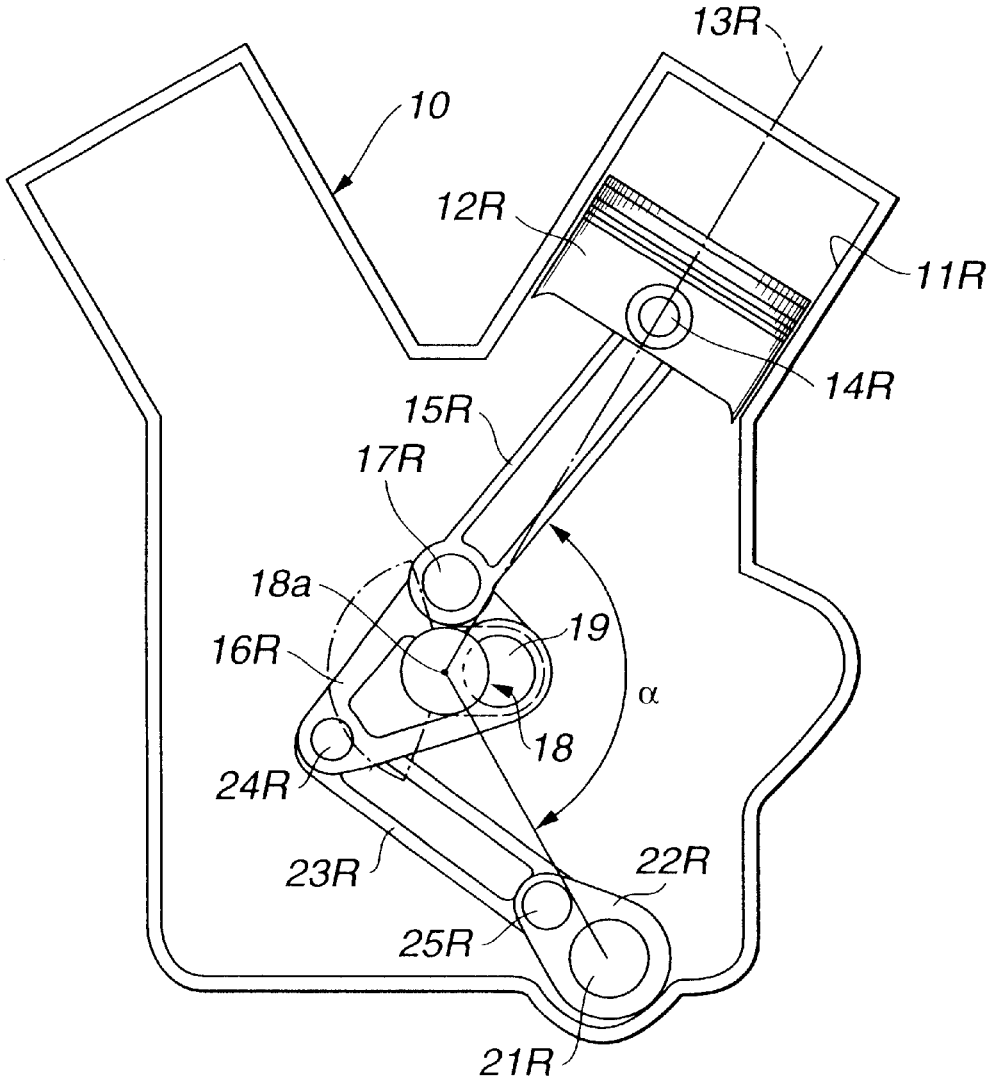
FIG. 4 is a cross-sectional view illustrating a detail linkage construction of the right cylinder bank side of the V-6 two-cycle engine of the first embodiment.
Figure 5A:
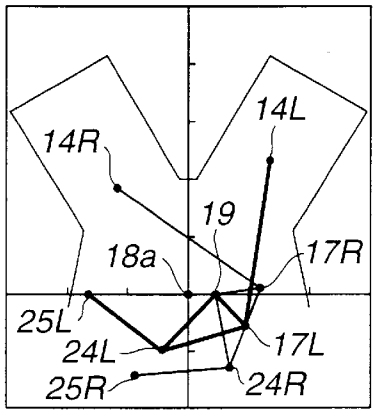
FIGS. 5A–5F are explanatory views showing the linkage layout of left-bank and right-bank linkages in the piston actuation system of the V-6 two-cycle engine of the first embodiment, for each 60° crank angle.
Figure 5B:
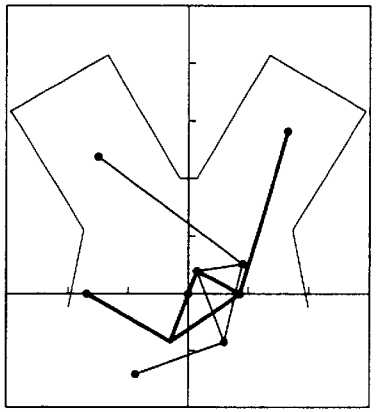
Figure 5C:
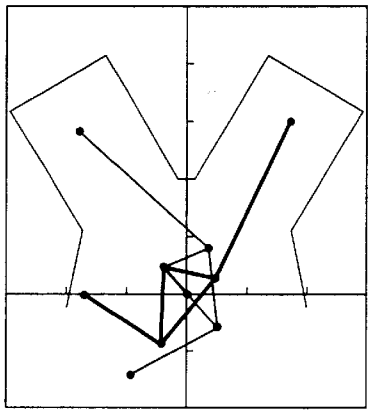
Figure 5D:
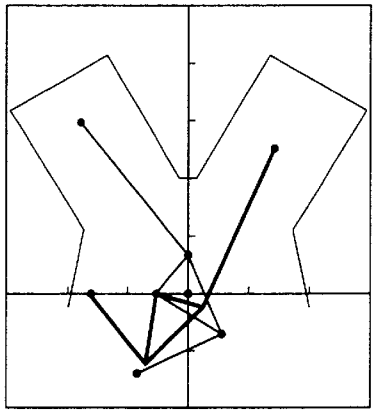
Figure 5E:
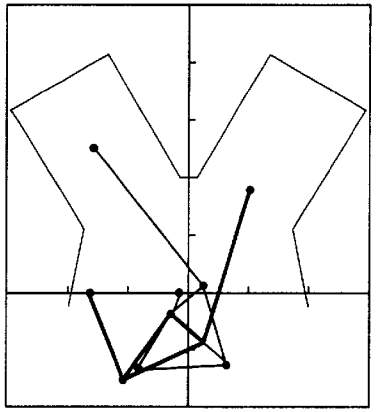
Figure 5F:
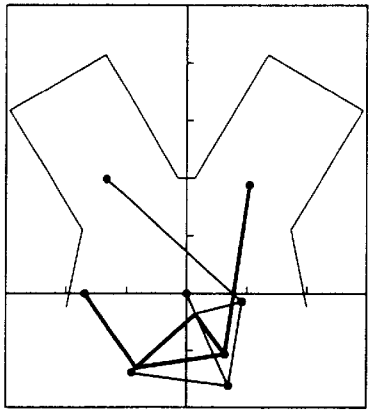

Referring now to the drawings, particularly to FIGS. 1 through 6, the improved arrangement of the piston actuation system of the first embodiment is exemplified in a V-type two-cycle internal combustion engine with left and right cylinder banks each equipped with a variable compression ratio mechanism. The two banks are in the same plane, separated by a predetermined bank angle. In case of necessity for discrimination between the left and right banks, the character "L" is added to indicate component parts related to the left bank, whereas the character "R" is added to indicate component parts related to the right bank. FIG. 1 shows a pair of cylinders 11L and 11R respectively arranged in the left and right banks of a cylinder block 10. Actually, three pairs of cylinders (11L, 11R; 11L, 11R; 11L, 11R) are juxtaposed to each other in the cylinder row direction (in a direction perpendicular to a space of FIG. 1). For the purpose of simplification of the disclosure, only the construction of one pair of cylinders 11L and 11R respectively arranged in the left and right banks will be hereinafter described in detail.

A right-hand piston 12L is slidably disposed in the right-hand cylinder 11L, whereas a left-hand piston 12R is slidably disposed in the left-hand cylinder 11R. In the first embodiment, a predetermined bank angle between a cylinder centerline 13L of the left bank, hereinafter referred to as a "left-bank cylinder centerline" and a cylinder centerline 13R of the right bank, hereinafter referred to as a "right-bank cylinder centerline" is set to 60 degrees. A multiple-link variable compression ratio mechanism linked to left-bank piston 12L is mainly comprised of a left-bank upper link 15L, a left-bank lower link 16L, and a left-bank control link 23L, whereas a multiple-link variable compression ratio mechanism linked to right-bank piston 12R is mainly comprised of a right-bank upper link 15R, a right-bank lower link 16R, and a right-bank control link 23R. The upper end of left-bank upper link 15L is rotatably connected to a piston pin 14L of left-bank piston 12L, while the upper end of right-bank upper link 15R is rotatably connected to a piston pin 14R of right-bank piston 12R. On the other hand, the lower end of left-bank upper link 15L is rotatably connected to left-bank lower link 16L via a first joint or a first connecting pin 17L, while the lower end of right-bank upper link 15R is rotatably connected to right-bank lower link 15R via a first joint or a first connecting pin 17R. A crankpin 19 whose axis is eccentric to an axis of the crankshaft 18 and on which one of the pair of lower links 16L and 16R is rotatably fitted and a crankpin 19 whose axis is eccentric to the axis of the crankshaft 18 and on which the other of the pair of lower links 16L and 16R is rotatably fitted, are coaxially arranged with each other. Actually, in the shown embodiment, the crankpin on which the one of the pair of lower links 16L and 16R is rotatably fitted and the crankpin on which the other lower link is rotatably fitted, are the same one. Thus, the pair of lower links 16L and 16R are coaxially fitted on an outer periphery of one crankpin 19 (the same crankpin) whose axis is eccentric to the axis of crankshaft 18, so as to be relatively rotatable about the same crankpin 19 (see FIG. 2). That is, the one crankpin 19 is common to the pair of lower links 16L and 16R, respectively arranged in the left and right banks. As compared to the previously-discussed offset arrangement of two adjacent crankpins respectively arranged in left and right banks, the number of crankpins can be reduced to half. In the V-6 engine of the first embodiment the number of crankpins is three. In contrast, in the conventional V-6 engine with the offset arrangement of two adjacent crankpins the number of crankpins is six. Due to the reduced number of crankpins, the piston actuation system of the V-6 two-cycle engine of the first embodiment is simple in construction. Thus, it is possible to satisfactorily ensure an effective width of crankpin 19 without increasing the engine's overall length measured in the axial direction of the crankshaft.

One end of left-bank control link 23L is connected to left-bank lower link 16L via a second joint or a second connecting pin 24L so as to be rotatable relative to the left-bank lower link. In the same manner, one end of right-bank control link 23R is connected to right-bank lower link 16R via a second joint or a second connecting pin 24R so as to be rotatable relative to the right-bank lower link. When changing the compression ratio of the engine, the other end of each of control links 23L and 23R is moved relative to the cylinder block corresponding to a stationary body of the engine by means of a compression ratio control means or a control mechanism. The control mechanism has at least left-bank control shaft 21L and right-bank control shaft 21R rotatably supported on cylinder block 10, and a pair of control levers 22L and 22R fixedly connected to the respective control shafts 21L and 21R. An eccentric support portion of left-bank control lever 22L, which eccentric support portion is eccentric to the center of left-bank control shaft 21L, is rotatably connected to the other end of left-bank control link 23L by way of a third joint or a third connecting pin 25L. An eccentric support portion of right-bank control lever 22R, which eccentric support portion is eccentric to the center of right-bank control shaft 21R, is rotatably connected to the other end of right-bank control link 23R by way of a third joint or a third connecting pin 25R. As can be appreciated from the cross sections of FIGS. 1, 3, and 4, control shaft 21 is arranged parallel to the axis of crankshaft 18 and provided for each cylinder bank. That is, in the piston actuation system of the V-6 two-cycle engine of the first embodiment, a total of two control shafts (21L, 21R) are provided. On the other hand, control lever 22 is provided for each engine cylinder. Three control levers (22, 22, 22) are provided for each control shaft 21. That is, a total of six control levers (22L, 22L, 22L, 22R, 22R, 22R) are provided.

In the first embodiment, the linkage constructions are substantially the same in the left and right banks. Concretely, the effective dimensions among upper link 15L, lower link 16L, and control link 23L associated with the left bank are set to be substantially identical to those among upper link 15R, lower link 16R, and control link 23R associated with the right bank. Actually, the distance between first and second joints 17L and 24L is substantially identical to the distance between first and second joints 17R and 24R. The distance between second and third joints 24L and 25L is substantially identical to the distance between second and third joints 24R and 25R. Additionally, the distance between the axis of left-bank control shaft 21L and a center 18*a* and an axis of rotation of crankshaft 18 and the distance between the axis of right-bank control shaft 21R and the crankshaft rotation center 18*a* are set to be identical to each other. Furthermore, as seen from the cross sections of FIGS. 3 and 4, left-bank control shaft 21L is arranged at a predetermined position that the left-bank control shaft is rotated about crankshaft rotation center 18*a* from the left-bank cylinder centerline 13L (serving as a reference) by a predetermined angle $\alpha$ in a predetermined rotational direction (in a clockwise direction in FIGS. 1 and 3). On the other hand, right-bank control shaft 21R is arranged at a predetermined position that the right-bank control shaft is rotated about crankshaft rotation center 18*a* from the right-bank cylinder centerline 13R (serving as a reference) by substantially the same angle $\alpha$ in the same rotational direction (in a clockwise direction in FIGS. 1 and 4) as left-bank control shaft 21L. For the reasons discussed above, an angle $\beta$ between a line segment between and including the axis of left-bank control shaft 21L and crankshaft rotation center 18*a* and a line segment between and including the axis of right-bank control shaft 21R and crankshaft rotation center 18*a* is dimensioned to be substantially identical to the predetermined bank angle between left-bank cylinder centerline 13L and right-bank cylinder centerline 13R, set at 60 degrees to each other in the first embodiment. In the same manner, the distance between third joint 25L (the other end of left-bank control link 23L) and crankshaft rotation center 18*a* is set to be identical to the distance between third joint 25R (the other end of right-bank control link 23R) and crankshaft rotation center 18*a*. Third joint 25L included in the left-bank linkage is arranged at a predetermined position that third joint 25L is rotated about crankshaft rotation center 18*a* from the left-bank cylinder centerline 13L by a predetermined angle in a predetermined rotational direction (in a clockwise direction in FIGS. 1 and 3). On the other hand, third joint 25R included in the right-bank linkage is arranged at a predetermined position that third joint 25R is rotated about crankshaft rotation center 18*a* from the left-bank cylinder centerline 13L by substantially the same angle in the same rotational direction (in a clockwise direction in FIGS. 1 and 3) as third joint 25L included in the left-bank linkage.

The V-6 engine of the first embodiment is a two-cycle V-6 engine whose bank angle is set at 60 degrees. In order to provide the same interval of explosion between cylinders, the phase difference at TDC (top dead center) between left-bank piston 12L and right-bank piston 12R is set at 60 degrees equal to the predetermined bank angle of 60 degrees. As described previously, in the piston actuation system of the first embodiment, the linkage construction of the left bank is set or dimensioned to be substantially identical to the linkage construction of the right bank. Thus, it is possible to set the phase difference between the pair of pistons 12L and 12R at an angle equal to the predetermined bank angle of 60 degrees, while using the common crankpin 19 to the pair of lower links 16L and 16R respectively linked to left-bank piston 12L and right-bank piston 12R. With the comparatively simple linkage layout, the V-6 two-cycle engine of the first embodiment can realize explosion between cylinders at regular intervals. Additionally, the first embodiment has substantially the same linkage construction in left and right banks. This enhances design flexibility and ease of application to various V-type engines.

Concretely, when varying the compression ratio depending on engine operating conditions, the control shaft pair, namely left-bank control shaft 21L and right-bank control shaft 21R are driven or rotated in the same rotational direction by the same angle of rotation in synchronism with each other through the control mechanism, which is driven by means of an actuator such as an electric motor. As a result of this, the same motion takes place in the linkages of the left and right banks. That is, the eccentric support portions of control levers 22L and 22R (i.e., the centers of third joints 25L and 25R) serving as centers of oscillating motions of control links 23L and 23R, are rotated about control shafts 21L and 21R in the same rotational direction by the same angle in synchronism. As a consequence, by changing the oscillating-motion centers of left-bank control link 23L and right-bank control link 23R in synchronism, a condition of a motion of left-bank lower link 16L and a condition of a motion of right-bank lower link 16R both change in synchronism. Therefore, piston stroke characteristics (the distance between crankshaft rotation center 18*a* and left-bank piston pin 14L, T.D.C. position and B.D.C. position of left-bank piston 12L, and the distance between crankshaft rotation center 18*a* and right-bank piston pin 14R, T.D.C. position and B.D.C. position of right-bank piston 12R) of left-bank piston 12L linked via upper link 15L to lower link 16L and right-bank piston 12R linked via upper link 15R to lower link 16R also change in synchronism. As a result, a compression ratio of the combustion chamber in left-bank cylinder 11L and a compression ratio of the combustion chamber in right-bank cylinder 11R change. That is, it is possible to equally change the compression ratio of each cylinder, while maintaining explosion between cylinders at regular intervals. Instead of using the synchronous drive control for control shafts 21L and 21R, assuming that left-bank control shaft 21L and right-bank control shaft 21R are controlled independently of each other, it is difficult to accurately maintain the same interval of explosion between cylinders.

Referring now to FIGS. 5A–5F, there is shown the linkage layout of both the left-bank linkage and the right-bank linkage for each 60° crank angle (concretely, 90° crank angle after BDC, 150° crank angle after BDC, 30° crank angle after TDC, 90° crank angle after TDC, 150°crank angle after TDC, and 30° crank angle after BDC), in the piston actuation system of the V-6 two-cycle engine of the first embodiment. Note that FIG. 1 is viewed from the front end of the vehicle, whereas FIGS. 5A–5F are viewed from the rear end of the vehicle.

Figure 6:
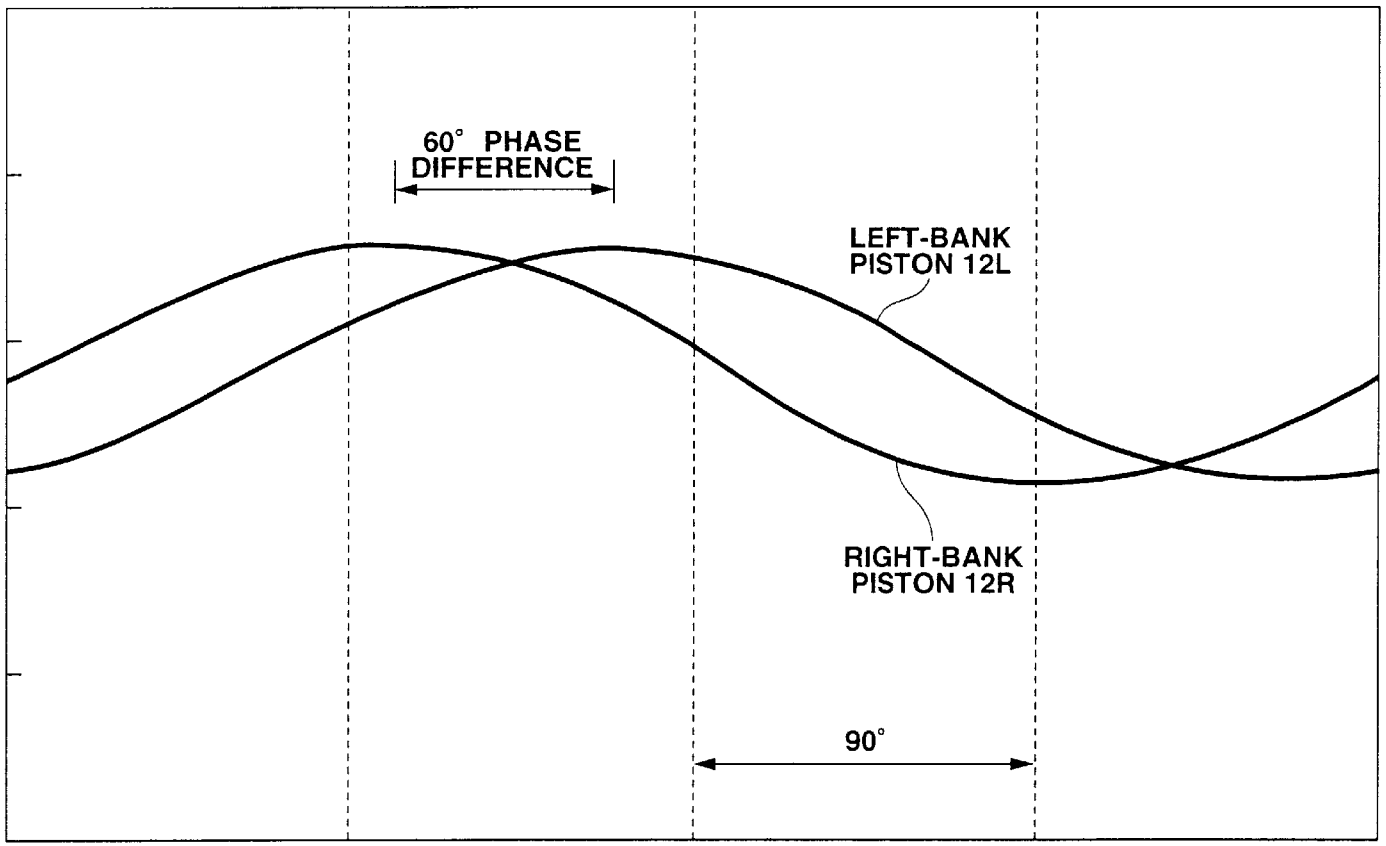
FIG. 6 is a characteristic diagram showing two piston stroke characteristics of the left and right banks, in the first embodiment.

FIG. 6 shows the piston stroke characteristic of left-bank piston 12L and the piston stroke characteristic of right-bank piston 12R, produced during operation of the piston actuation system of the V-6 two-cycle engine of the first embodiment. As can be appreciated from the two characteristic curves of FIG. 6, the phase difference between the two piston stroke characteristics is substantially 60 degrees. The piston actuation system of the V-6 two-cycle engine of the first embodiment provides a smooth, substantially sinusoidal waveform, as can be seen from the left-bank and right-bank piston stroke characteristic curves of FIG. 6.

Figure 7:
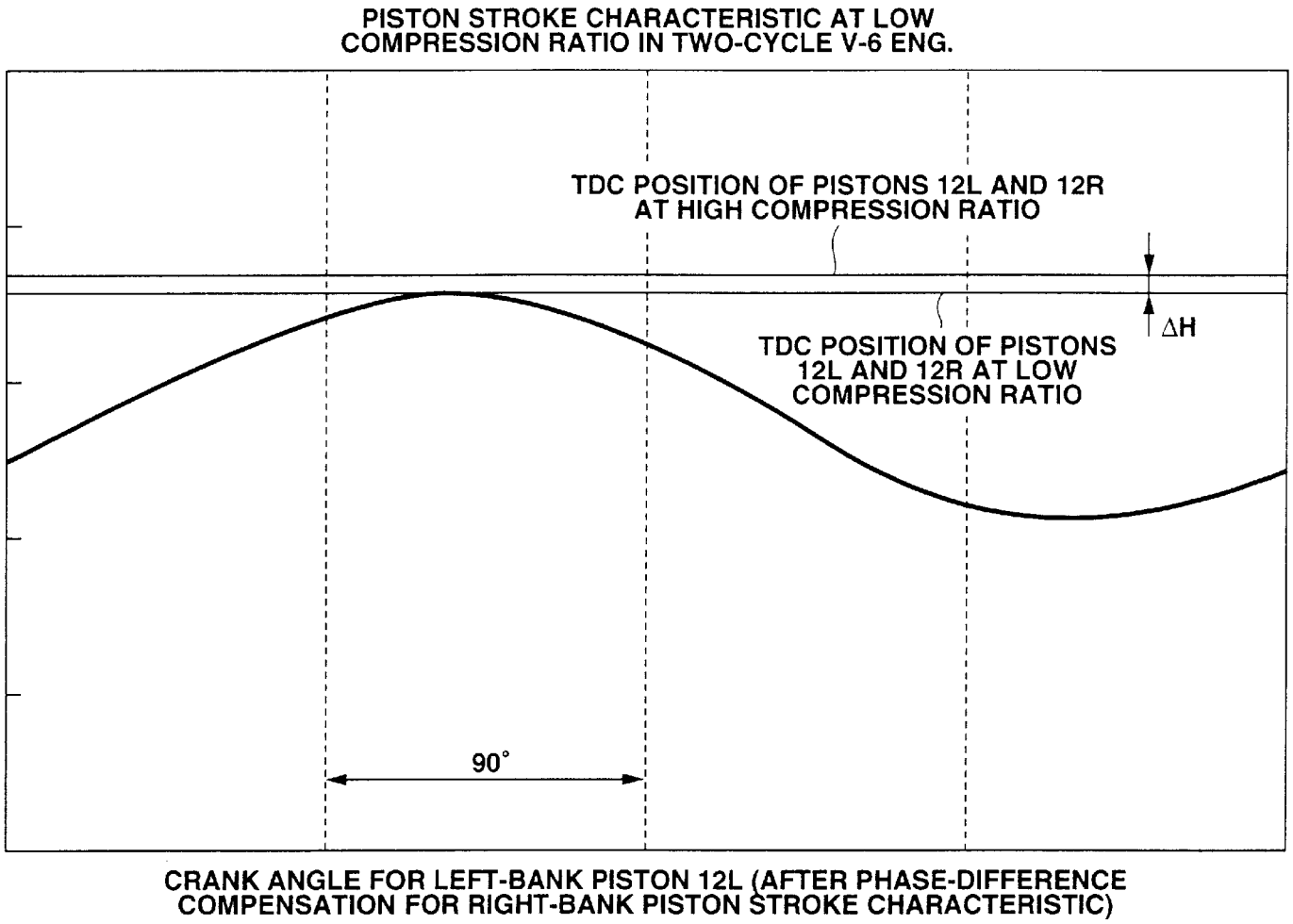
FIG. 7 shows characteristic curves (matched closely) produced by overlapping one of two piston stroke characteristics of the left and right banks, obtained under a low compression ratio, with the other.
Figure 8:
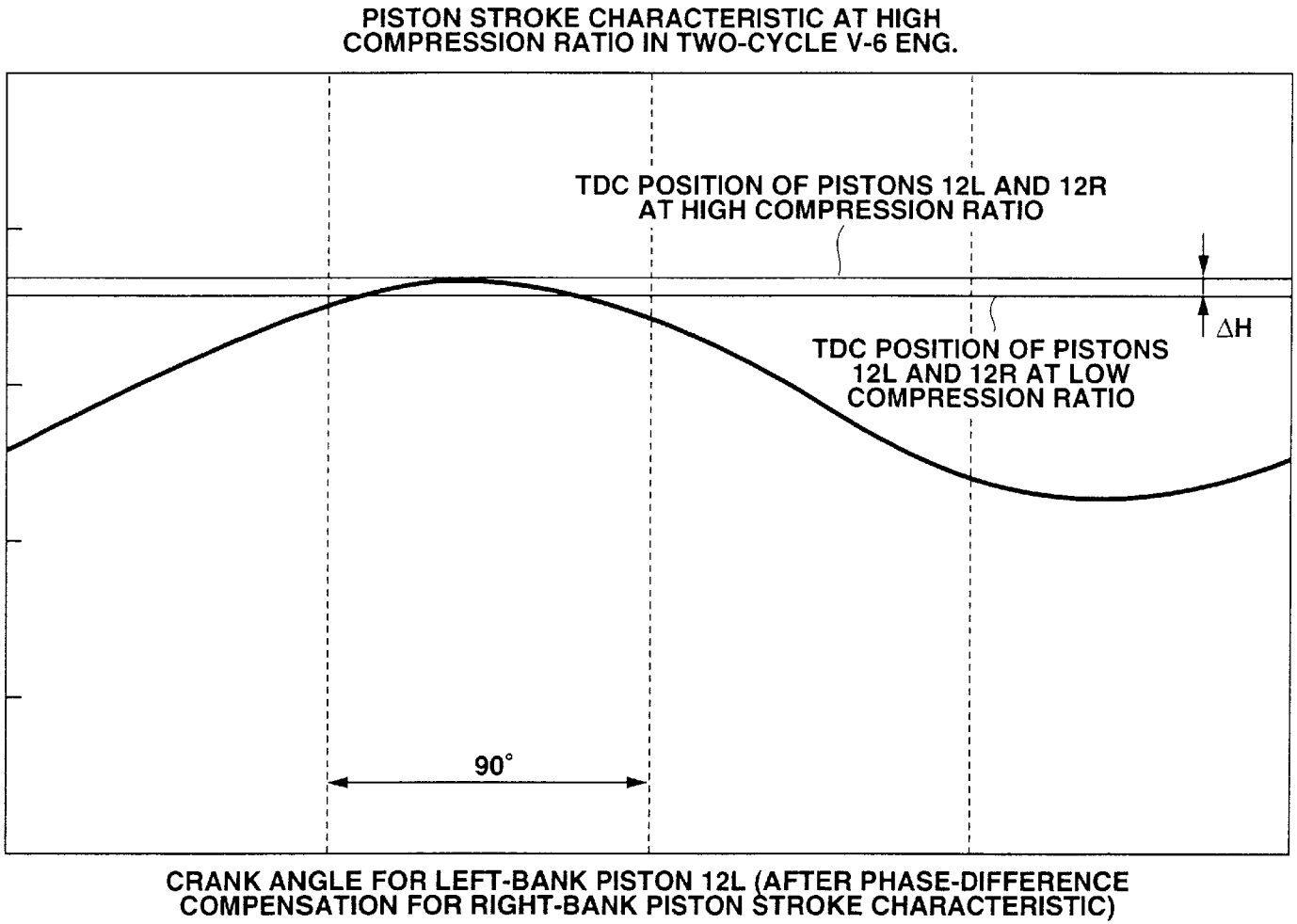
FIG. 8 shows characteristic curves (matched closely) produced by overlapping one of two piston stroke characteristics of the left and right banks, obtained under a high compression ratio, with the other.

Actually, there is a substantially 60° phase difference between the left-bank and right-bank piston stroke characteristics as shown in FIG. 6. FIG. 7 shows the left-bank and right-bank piston stroke characteristic curves matched closely on the assumption that there is no phase difference between the left-bank piston stroke characteristic and the right-bank piston stroke characteristic under a low compression ratio. In contrast, FIG. 8 shows the left-bank and right-bank piston stroke characteristic curves matched closely on the assumption that there is no phase difference between the left-bank piston stroke characteristic and the right-bank piston stroke characteristic under a high compression ratio. As discussed above, in the first embodiment, the linkage constructions in the left and right banks are substantially the same. Thus, although actually there is a substantially 60° phase difference, the waveform of the left-bank piston stroke characteristic (the distance between crankshaft rotation center 18*a* and left-bank piston pin 14L, T.D.C. position and B.D.C. position of left-bank piston 12L) and the waveform of the right-bank piston stroke characteristic (the distance between crankshaft rotation center 18*a* and right-bank piston pin 14R, T.D.C. position and B.D.C. position of right-bank piston 12R) are identical to each other. As can be appreciated from comparison between the characteristic curves of FIGS. 7 and 8 (after the bank phase-difference compensation), the piston stroke characteristic obtained under the high compression ratio (see FIG. 8) is slightly shifted upwards by a length ΔH, as compared to the piston stroke characteristic obtained under the low compression ratio (see FIG. 7). In other words, the T.D.C. position of each of left-bank and right-bank pistons 12L and 12R, produced under the high compression ratio is slightly shifted upwards by the length ΔH, in comparison with that obtained under the low compression ratio.

Referring now to FIGS. 9, 10A–10F and 11, there is shown the piston actuation system of the V-6 four-cycle engine of the second embodiment.

The fundamental linkage design of the piston actuation system of the second embodiment is similar to that of the first embodiment. For the purpose of comparison between the first and second embodiments, the same reference signs used to designate elements shown in the first embodiment will be applied to the corresponding elements shown in the second embodiment.

The V-6 engine of the second embodiment is a four-cycle V-6 engine. In order to provide the same interval of explosion between cylinders, the phase difference at TDC between left-bank piston 12L and right-bank piston 12R has to be set at 120 degrees. For this reason, a predetermined bank angle of the four-cycle V-6 engine of the second embodiment is set at 120 degrees. In the same manner as the first embodiment of FIGS. 1–8, in the piston actuation system of the second embodiment of FIGS. 9–11, the linkage constructions are substantially the same in the left and right banks. As seen from the cross section of FIG. 9, left-bank control shaft 21L is arranged at a predetermined position that the left-bank control shaft is rotated about crankshaft rotation center 18*a* from the left-bank cylinder centerline 13L by a predetermined angle in a predetermined rotational direction (in a clockwise direction in FIG. 9). Likewise, right-bank control shaft 21R is arranged at a predetermined position that the right-bank control shaft is rotated about crankshaft rotation center 18*a* from the right-bank cylinder centerline 13R by substantially the same angle in the same rotational direction (in a clockwise direction in FIG. 9) as left-bank control shaft 21L. In the same manner, left-bank third joint 25L is arranged at a predetermined position that third joint 25L is rotated about crankshaft rotation center 18*a* from the left-bank cylinder centerline 13L by a predetermined angle in a predetermined rotational direction (in a clockwise direction in FIG. 9), whereas right-bank third joint 25R is arranged at a predetermined position that third joint 25R is rotated about crankshaft rotation center 18*a* from the right-bank cylinder centerline 13R by substantially the same angle in the same rotational direction (in a clockwise direction in FIG. 9) as left-bank third joint 25L. Thus, an angle β between a line segment between and including the axis of left-bank control shaft 21L and crankshaft rotation center 18*a* and a line segment between and including the axis of right-bank control shaft 21R and crankshaft rotation center 18*a* is dimensioned to be substantially identical to the predetermined bank angle between left-bank cylinder centerline 13L and right-bank cylinder centerline 13R, set at 120 degrees in the second embodiment.

Figure 9:
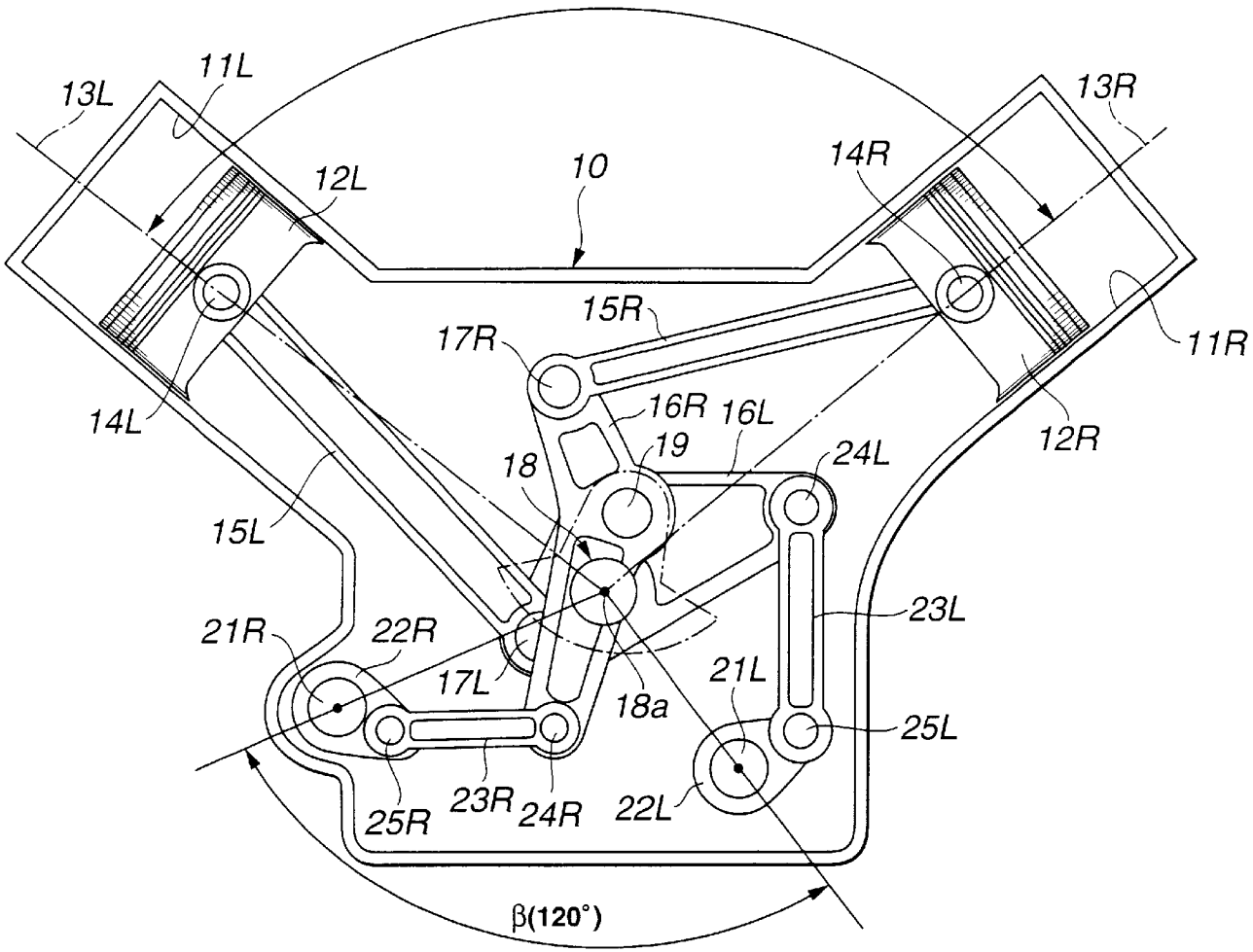
FIG. 9 is a cross-sectional view illustrating a piston actuation system of a V-6 four-cycle engine equipped with a multiple-link variable compression ratio mechanism, in a second embodiment.
Figure 10A:
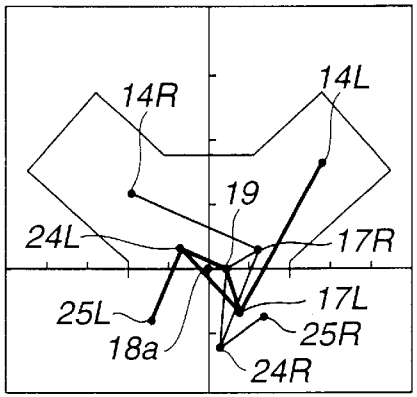
FIGS. 10A–10F are explanatory views showing the linkage layout of left-bank and right-bank linkages in the piston actuation system of the V-6 four-cycle engine of the second embodiment, for each 60° crank angle.
Figure 10B:
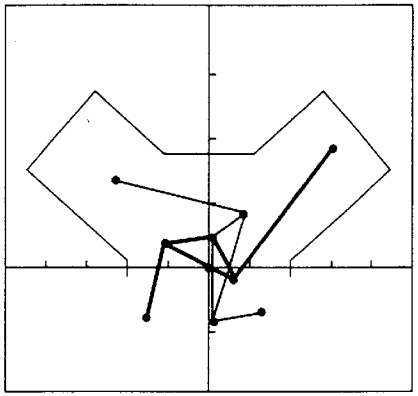
Figure 10C:
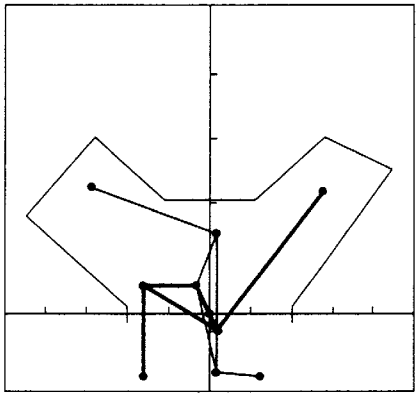
Figure 10D:
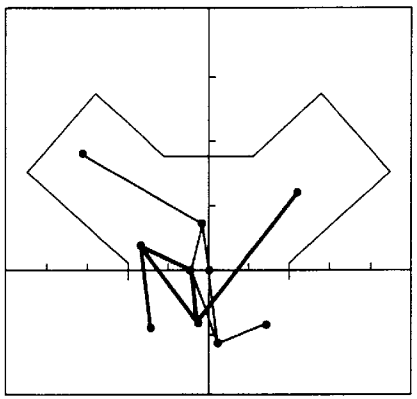
Figure 10E:
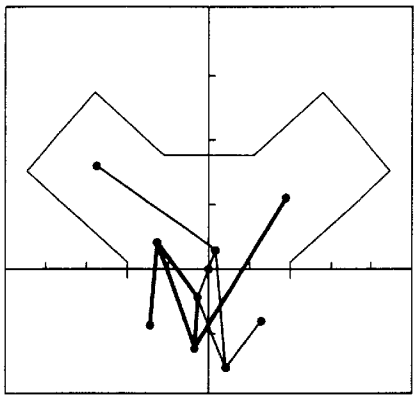
Figure 10F:
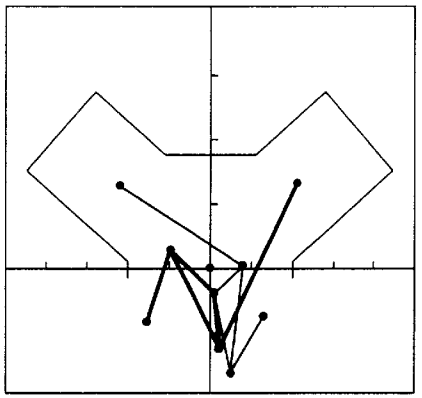

As shown in FIG. 9, the shape of left-bank lower link 16L is somewhat different from that of right-bank lower link 16R, but the principal dimensions (distances among the first, second, third joints) among left-bank link parts are set to be substantially identical to those among right-bank link parts.

Referring now to FIGS. 10A–10F, there is shown the linkage layout of both the left-bank linkage and the right-bank linkage for each 120° crank angle, in the piston actuation system of the V-6 four-cycle engine of the second embodiment. Note that FIG. 9 is viewed from the front end of the vehicle, whereas FIGS. 10A–10F are viewed from the rear end of the vehicle.

Figure 11:
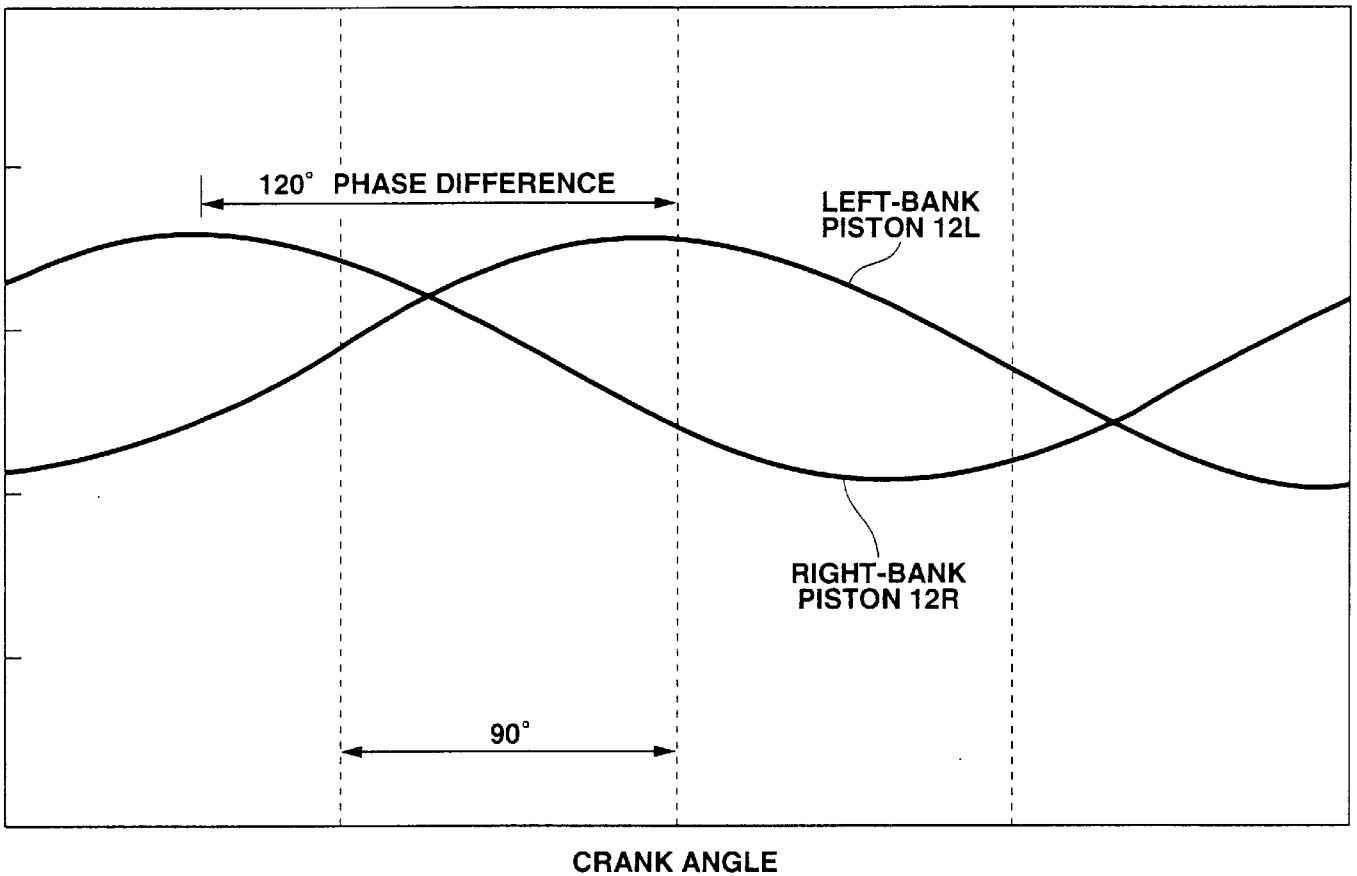
FIG. 11 is a characteristic diagram showing two piston stroke characteristics of the left and right banks, in the second embodiment.

FIG. 11 shows the piston stroke characteristic of left-bank piston 12L and the piston stroke characteristic of right-bank piston 12R, produced during operation of the piston actuation system of the V-6 four-cycle engine of the second embodiment. As can be appreciated from the two characteristic curves of FIG. 11, the phase difference between the two piston stroke characteristics is substantially 120 degrees. The piston actuation system of the V-6 four-cycle engine of the second embodiment provides a smooth, substantially sinusoidal waveform, as can be seen from the left-bank and right-bank piston stroke characteristic curves of FIG. 11.

The entire contents of Japanese Patent Application No. P2001-54392 (filed Feb. 28, 2001) is incorporated herein by reference.

While the foregoing is a description of the preferred embodiments carried out the invention, it will be understood that the invention is not limited to the particular embodiments shown and described herein, but that various changes and modifications maybe made without departing from the scope or spirit of this invention as defined by the following claims.

What is claimed is:

1. A piston actuation system of a V-type internal combustion engine with a crankshaft and two cylinder banks having at least one pair of cylinders whose centerlines are set at a predetermined bank angle to each other, a pair of pistons slidably disposed in the respective cylinders, comprising:

cylinders arranged in a V-type configuration;

a pair of upper links connected to piston pins of the pistons so as to be rotatable relative to the respective piston pins;

a pair of lower links directly connected to the upper links so as to be rotatable relative to the respective upper links and directly connected to a pair of control links at their first ends so as to be rotatable relative to the respective lower links;

a control mechanism that is connected to the second end of each of the control links to move the second end of each of the control links relative to a body of the engine when changing a compression ratio of the engine; and a crankpin whose axis is eccentric to an axis of the crankshaft, wherein, each link of the pair of lower links are fitted on an outer periphery of the crankpin whose axis is eccentric to an axis of the crankshaft.

2. The piston actuation system as claimed in claim 1, wherein:

effective dimensions of the upper link, the lower link, and the control link in a first one of the two cylinder banks are substantially identical to effective dimensions of the upper link, the lower link, and the control link in the second cylinder bank.

3. The piston actuation system as claimed in claim 1, wherein:

a distance between the second end of the control link included in a first one of the two cylinder banks and a rotation center of the crankshaft is set to be substantially identical to the second end of the control link included in the second cylinder bank; and the second ends of the pair of control links are arranged at predetermined positions that the second ends are rotated about the rotation center of the crankshaft from the respective cylinder centerlines by substantially the same angle in the same rotational direction.

4. The piston actuation system as claimed in claim 1, wherein:

the control mechanism comprises a pair of control shafts extending parallel to the crankshaft and being rotated relative to the body of the engine when changing the compression ratio and a pair of control levers having eccentric support portions eccentric to the centers of the pair of control shafts and rotatably connected to the second ends of the pair of control links;

a distance between the control shaft included in a first one of the two cylinder banks and a rotation center of the crankshaft is set to be substantially identical to the control shaft included in the second cylinder bank; and the pair of control shafts are arranged at predetermined positions that the control shafts are rotated about the rotation center of the crankshaft from the respective cylinder centerlines by substantially the same angle in the same rotational direction.

5. The piston actuation system as claimed in claim 4, wherein:

the pair of control shafts are rotated by the same angle in the same rotational direction in synchronism, when changing the compression ratio.

6. The piston actuation system as claimed in claim 1, wherein:

effective dimensions of the upper links, the lower links, and the control links in the left and right banks are set, so that a phase difference at a top dead center between the pair of pistons is substantially 60 degrees when the predetermined bank angle is substantially 60 degrees.

7. The piston actuation system as claimed in claim 1, wherein:

effective dimensions of the upper links, the lower links, and the control links in the left and right banks are set, so that a phase difference at a top dead center between the pair of pistons is substantially 120 degrees when the predetermined bank angle is substantially 120 degrees.

8. A piston actuation system of a V-type internal combustion engine with crankshaft and two cylinder banks having at least one pair of cylinders whose centerlines set at a predetermined bank angle to each other, a pair of pistons slidably disposed in the respective cylinders, comprising:

cylinders arranged in a V-type configuration;

a pair of upper links connected to piston pins of the pistons so as to be rotatable relative to the respective piston pins;

a pair of lower links directly connected to the upper links so as to be rotatable relative to the respective upper links and directly connected to a pair of control links at their first ends so as to be rotatable relative to the respective lower links;

a compression ratio control means that is connected to the second end of each of the control links to move the second end of each of the control links relative to a body of the engine when changing a compression ratio of the engine; and a crankpin whose axis is eccentric to an axis of the crankshaft, wherein, each link of the pair of lower links are fitted on an outer periphery of the crankpin whose axis is eccentric to an axis of the crankshaft.

9. A piston actuation system of a V-type internal combustion engine with a crankshaft and two cylinder banks having at least one pair of cylinders whose centerlines are set at a predetermined bank angle to each other, a pair of pistons slidably disposed in the respective cylinders, comprising:

cylinders arranged in a V-type configuration;

a pair of upper links connected to piston pins of the pistons so as to be rotatable relative to the respective piston pins;

a pair of lower links directly connected to the upper links so as to be rotatable relative to the respective upper links, and directly connected to a pair of control links at their first ends so as to be rotatable relative to the respective lower links;

a control mechanism that is connected to the second end of each of the control links to move the second end of each of the control links relative to a body of the engine when changing a compression ratio of the engine; and a crankpin whose axis is eccentric to an axis of the crankshaft and on which a first one of the pair of lower links is rotatably fitted and a crankpin whose axis is eccentric to the axis of the crankshaft and on which the second lower link is rotatably fitted, being permanently coaxially arranged with each other.

10. The piston actuation system as claimed in claim 9, wherein:

effective dimensions of the upper link, the lower link, and the control link in a first one of the two cylinder banks are substantially identical to effective dimensions of the upper link, the lower link, and the control link in the second cylinder bank.

11. The piston actuation system as claimed in claim 9, wherein:

a distance between the second end of the control link included in a first one of the two cylinder banks and a rotation center of the crankshaft is set to be substantially identical to the second end of the control link included in the second cylinder bank; and the second ends of the pair of control links are arranged at predetermined positions that the second ends are rotated about the rotation center of the crankshaft from the respective cylinder centerlines by substantially the same angle in the same rotational direction.

12. The piston actuation system as claimed in claim 9, wherein:

the control mechanism comprises a pair of control shafts extending parallel to the crankshaft and being rotated relative to the body of the engine when changing the compression ratio and a pair of control levers having eccentric support portions eccentric to the centers of the pair of control shafts and rotatably connected to the second ends of the pair of control links;

a distance between the control shaft included in a first one of the two cylinder banks and a rotation center of the crankshaft is set to be substantially identical to the control shaft included in the second cylinder bank; and the pair of control shafts are arranged at predetermined positions that the control shafts are rotated about the rotation center of the crankshaft from the respective cylinder centerlines by substantially the same angle in the same rotational direction.

13. The piston actuation system as claimed in claim 12, wherein:

the pair of control shafts are rotated by the same angle in the same rotational direction in synchronism, when changing the compression ratio.

14. The piston actuation system as claimed in claim 10, wherein:

effective dimensions of the upper links, the lower links, and the control links in the left and right banks are set, so that a phase difference at a top dead center between the pair of pistons is substantially 60 degrees when the predetermined bank angle is substantially 60 degrees.

15. The piston actuation system as claimed in claim 10, wherein:

effective dimensions of the upper links, the lower links, and the control links in the left and right banks are set, so that a phase difference at a top dead center between the pair of pistons is substantially 120 degrees when the predetermined bank angle is substantially 120 degrees.

16. A piston actuation system of a V-type internal combustion engine with a crankshaft and two cylinder banks having at least one pair of cylinders whose centerlines are set at a predetermined bank angle to each other, a pair of pistons slidably disposed in the respective cylinders, comprising:

cylinders arranged in a V-type configuration;

a pair of upper links connected to piston pins of the pistons so as to be rotatable relative to the respective piston pins;

a pair of lower links directly connected to the upper links so as to be rotatable relative to the respective upper links, and directly connected to a pair of control links at their first ends so as to be rotatable relative to the respective lower links;

a compression ratio control means that is connected to the second end of each of the control links to move the second end of each of the control links relative to a body of the engine when changing a compression ratio of the engine; and a crankpin whose axis is eccentric to an axis of the crankshaft and on which a first one of the pair of lower links is rotatably fitted and a crankpin whose axis is eccentric to the axis of the crankshaft and on which the second lower link is rotatably fitted, being permanently coaxially arranged with each other.

* * * * *